US007713493B2

(12) United States Patent
Bosanec, Jr. et al.

(10) Patent No.: US 7,713,493 B2
(45) Date of Patent: May 11, 2010

(54) COMPACT COMBINATION EXHAUST MUFFLER AND AFTERTREATMENT ELEMENT AND WATER TRAP ASSEMBLY

(75) Inventors: John M. Bosanec, Jr., Lake Mills, WI (US); Patrick M. Klein, Madison, WI (US); Jeffrey T. Sedlacek, Stoughton, WI (US); David M. Grimm, Verona, WI (US)

(73) Assignee: Fleetguard, Inc., Nashville, TN (US)

( * ) Notice: Subject to any disclaimer, the term of this patent is extended or adjusted under 35 U.S.C. 154(b) by 1174 days.

(21) Appl. No.: 11/315,998

(22) Filed: Dec. 22, 2005

(65) Prior Publication Data

US 2007/0039316 A1 Feb. 22, 2007

Related U.S. Application Data

(63) Continuation-in-part of application No. 11/243,694, filed on Oct. 5, 2005, now Pat. No. 7,582,267, and a continuation-in-part of application No. 11/142,085, filed on Jun. 1, 2005, now Pat. No. 7,347,044, which is a continuation-in-part of application No. 11/085,715, filed on Mar. 21, 2005, now Pat. No. 7,114,330, which is a continuation of application No. 10/376,424, filed on Feb. 28, 2003, now Pat. No. 6,868,670.

(51) Int. Cl.
*B01D 50/00* (2006.01)
*F01N 3/02* (2006.01)

(52) U.S. Cl. ..... 422/180; 60/309

(58) Field of Classification Search ..... 422/168, 422/180; 181/123; 60/309, 312
See application file for complete search history.

(56) References Cited

U.S. PATENT DOCUMENTS

| | | | | |
|---|---|---|---|---|
| 2,273,210 | A | | 1/1942 | Lowther et al. |
| 2,363,236 | A | * | 11/1944 | Fluor ..... 181/262 |
| 2,446,631 | A | | 8/1948 | Burks |
| 2,482,577 | A | | 9/1949 | Dahlstrom |
| 2,721,619 | A | | 10/1955 | Cheairs |
| 2,732,913 | A | | 1/1956 | Higgins |
| 2,732,092 | A | | 6/1956 | Lawrence |
| 2,921,432 | A | | 1/1960 | Marcotte et al. |
| 3,078,650 | A | | 2/1963 | Anderson et al. |
| 3,423,909 | A | | 1/1969 | Bennett et al. |

(Continued)

FOREIGN PATENT DOCUMENTS

| | | |
|---|---|---|
| GB | 882647 | 11/1961 |

(Continued)

*Primary Examiner*—Tom Duong
(74) *Attorney, Agent, or Firm*—Andrus, Sceales, Starke & Sawall, LLP; J. Bruce Schelkopf

(57) ABSTRACT

An ultra-compact combination exhaust muffler and aftertreatment element and water trap assembly provides exhaust flow through an aftertreatment element surrounded by an annular water collection space receiving water diverted and shed from an upper dome cap above the aftertreatment element and below the upper outlet. In a further embodiment, the assembly includes housing sections separable from each other at a service joint axially between axial ends of the aftertreatment element for ease of servicing. In a further aspect, the aftertreatment element has an axial end within a housing section saving axial extension space.

12 Claims, 13 Drawing Sheets

U.S. PATENT DOCUMENTS

| | | | | | |
|---|---|---|---|---|---|
| 3,616,618 | A | | 11/1971 | Gronholz et al. | |
| 3,672,464 | A | * | 6/1972 | Rowley et al. | 181/253 |
| 3,817,221 | A | | 6/1974 | Nohira et al. | |
| 3,834,134 | A | | 9/1974 | McAllister | |
| 4,020,783 | A | | 5/1977 | Anderson et al. | |
| 4,278,455 | A | | 7/1981 | Nardi | |
| 4,312,651 | A | | 1/1982 | Easki et al. | |
| 4,378,983 | A | | 4/1983 | Martin | |
| 4,450,934 | A | * | 5/1984 | Davis | 181/228 |
| 4,488,889 | A | | 12/1984 | McCarroll | |
| 4,527,659 | A | | 7/1985 | Harrington | |
| 4,629,226 | A | | 12/1986 | Cassel et al. | |
| 4,632,216 | A | * | 12/1986 | Wagner et al. | 181/255 |
| 5,170,020 | A | | 12/1992 | Kruger et al. | |
| 5,216,809 | A | | 6/1993 | Abbott et al. | |
| 5,321,215 | A | | 6/1994 | Kicinski | |
| 5,746,630 | A | * | 5/1998 | Ford et al. | 440/89 R |
| 5,808,245 | A | | 9/1998 | Wiese et al. | |
| 6,152,258 | A | | 11/2000 | Deavers et al. | |
| 6,158,546 | A | | 12/2000 | Hanson et al. | |
| 6,250,075 | B1 | * | 6/2001 | Funakoshi et al. | 60/299 |
| 6,412,595 | B1 | | 7/2002 | Horak et al. | |
| 6,430,921 | B1 | | 8/2002 | Stuart et al. | |
| 6,802,387 | B1 | | 10/2004 | Kreger et al. | |
| 6,824,743 | B1 | | 11/2004 | Pawson et al. | |
| 6,868,670 | B1 | * | 3/2005 | Schellin | 60/309 |
| 7,451,594 | B2 | * | 11/2008 | Blaisdell | 60/324 |

FOREIGN PATENT DOCUMENTS

| | | | |
|---|---|---|---|
| GB | 02 919 378 | | 6/1979 |
| JP | 358202323 | A | 11/1983 |
| JP | 411072018 | | 3/1999 |

* cited by examiner

FIG. 3A
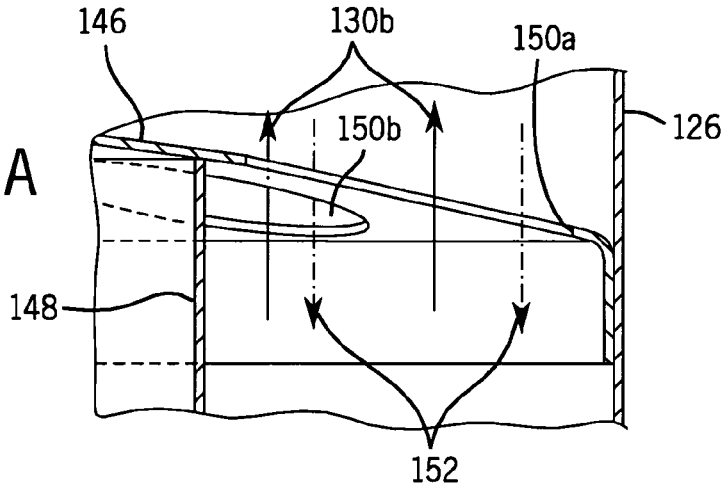
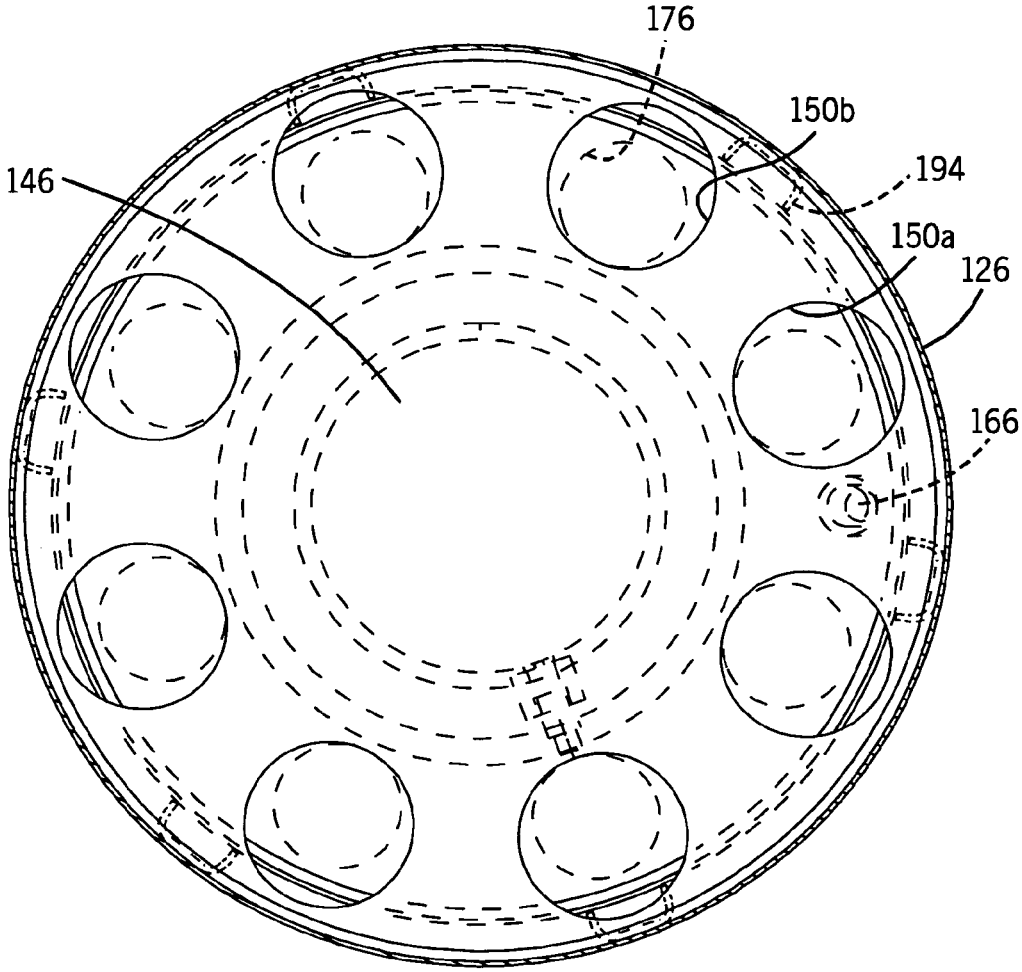
FIG. 4

COMPACT COMBINATION EXHAUST MUFFLER AND AFTERTREATMENT ELEMENT AND WATER TRAP ASSEMBLY

CROSS-REFERENCE TO RELATED APPLICATIONS

This application is a continuation-part of U.S. patent application Ser. No. 11/243,694, filed Oct. 5, 2005, now U.S. Pat. No. 7,582,267 and a continuation-in-part of U.S. patent application Ser. No. 11/142,085, filed Jun. 1, 2005, now U.S. Pat. No. 7,347,044 which is a continuation-in-part of U.S. patent application Ser. No. 11/085,715, filed Mar. 21, 2005, now U.S. Pat. No. 7,114,330 which is a continuation of Ser. No. 10/376,424, filed Feb. 28, 2003 U.S. Pat. No. 6,868,670, all incorporated herein by reference.

BACKGROUND AND SUMMARY

The invention relates to vertical exhaust systems and exhaust water trap assemblies, including for heavy duty vehicles, such as trucks, tractors, off-road equipment, and the like which utilize a vertical exhaust system, for example in which the exhaust conduit extends vertically alongside the cab of the vehicle.

For reduced emissions, catalytic converters and soot filters have been incorporated in the exhaust system of buses, trucks, and so on. If the exhaust outlet is vertical, there is a possibility that water, such as rain, snow, or bus or truck wash, can enter the upper end of the exhaust system and flow downwardly into contact with the catalytic converter or soot filter unit. The water entering the system can be absorbed in the catalyst/filter mounting mat, e.g. vermiculite, that is typically located between the outer surface of the catalytic converter and the outer body of the exhaust conduit. Mounting mat that is exposed to water results in a much lower push-out force, a measure of the ability for the mat to retain the catalyst/filter in place. In another scenario, freezing of water in the catalytic converter can cause structural damage to the monolithic catalyst. As an additional problem, water flowing through the catalytic converter or soot filter may tend to wash particulate material downwardly where such material collects and clogs the lower surface of the catalytic converter/soot filter causing premature failure thereof.

The present invention arose during continuing development efforts directed toward an improved combination exhaust muffler and aftertreatment element and water trap assembly, including ultra-compact structure.

BRIEF DESCRIPTION OF THE DRAWINGS

FIGS. 1-6 are taken from above noted parent U.S. patent application Ser. No. 11/142,085.

FIG. 1 is a side sectional view of an exhaust water trap assembly.

FIG. 2 is a view of a portion of FIG. 1 and showing an alternate embodiment.

FIG. 3 is a side sectional view of an exhaust water trap assembly.

FIG. 3A is an enlarged view taken along line 3A-3A of FIG. 3.

FIG. 4 is a sectional view taken along line 4-4 of FIG. 3.

FIG. 5 is a sectional view taken along line 5-5 of FIG. 3.

FIG. 6 is a sectional view taken along line 6-6 of FIG. 3.

FIG. 7 is a cutaway perspective view of an aftertreatment exhaust assembly.

FIG. 8 is an exploded perspective view of the assembly of FIG. 7.

FIG. 9 is like FIG. 7 and shows another embodiment.

FIG. 10 is a cutaway exploded perspective view of the assembly of FIG. 9.

DETAILED DESCRIPTION

The following description of FIGS. 1-6 is taken from above noted parent U.S. patent application Ser. No. 11/142,085.

Figure 1:
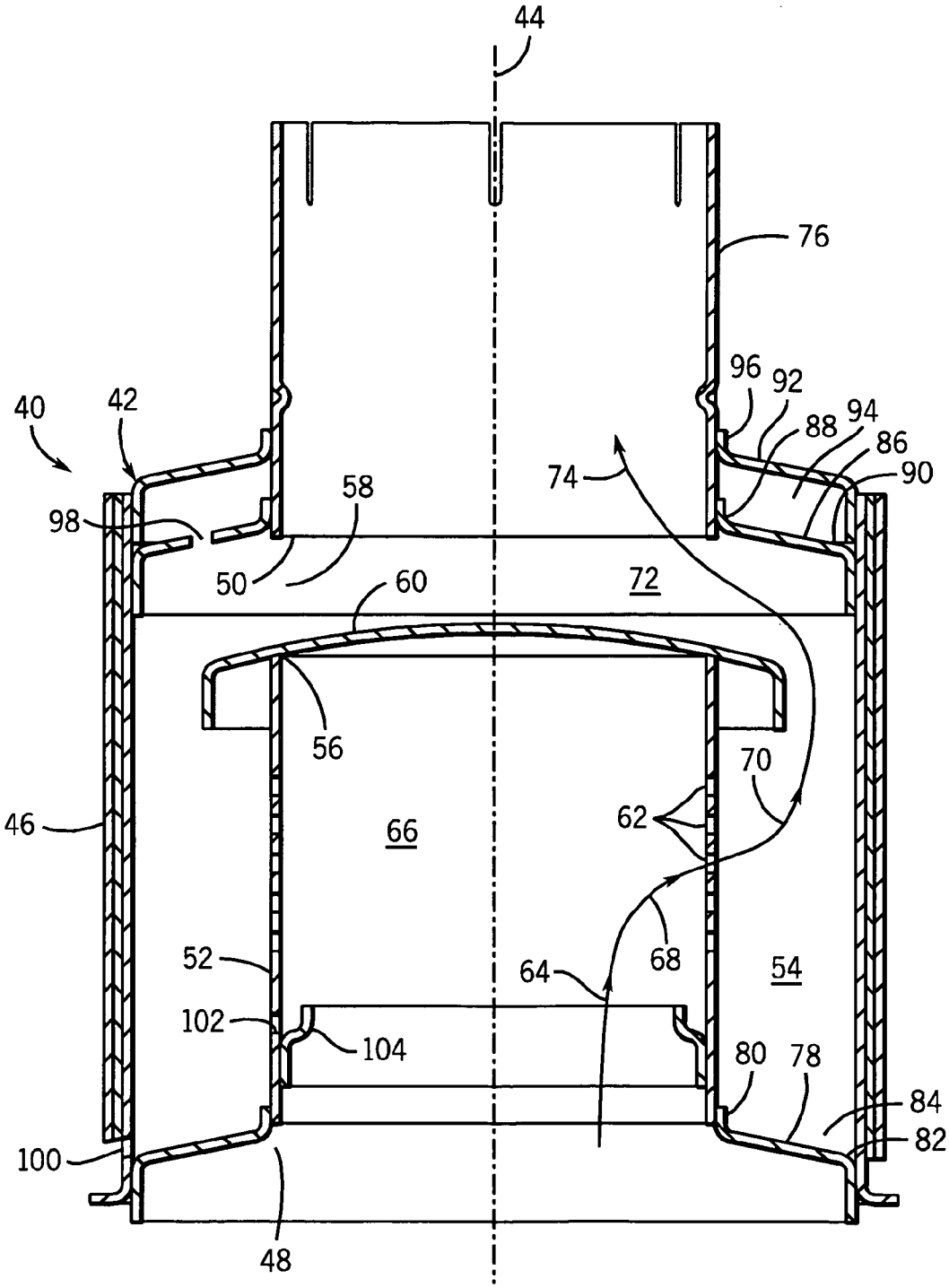

FIG. 1 shows an exhaust water trap assembly 40 including a housing 42 extending axially along a vertical axis 44 and having a housing sidewall 46. The housing has a lower inlet 48 for receiving exhaust from an internal combustion engine through a catalytic converter or soot filter, and an upper outlet 50 for discharging the exhaust and which is spaced above lower inlet 48. An internal exhaust tube 52 extends upwardly from lower inlet 48 and is spaced radially inwardly of housing sidewall 46 by a radial gap defining an annular space 54 therebetween. Exhaust tube 52 has a top end 56 vertically spaced below upper outlet 50 by an axial gap 58. A dome cap or umbrella 60 on top end 56 spans internal exhaust tube 52 and blocks exhaust flow axially upwardly therepast, and blocks entry of water axially downwardly therepast into top end 56 of internal exhaust tube 52 from upper outlet 50 and instead diverts and sheds water radially outwardly into annular space 54. Exhaust tube 52 is perforated as shown at perforations 62, and hence exhaust flows axially upwardly as shown at arrow 64 from the internal combustion engine and the catalytic converter into assembly 40 through lower inlet 48 into interior 66 of internal exhaust tube 52, and then flows radially outwardly through perforations 62 as shown at arrow 68 into annular space 54 and then flows axially upwardly as shown at arrow 70 through annular space 54 past dome cap 60 and then into an upper plenum 72 and then to outlet 50 as shown at arrow 74 for discharge vertically axially upwardly through external exhaust tube 76.

A lower annular flange 78 has an inner circumference 80 at internal exhaust tube 52 and defining lower inlet 48, and has an outer circumference 82 at housing sidewall 46 and spanning and closing annular space 54 at a lower end thereof to form a collection space and water trap 84, comparable to water trap 27 in U.S. Pat. No. 5,321,215. An upper flange 86 has an inner circumference 88 spaced vertically above top end 56 of internal exhaust tube 52 and dome cap 60 by axial gap 58 and defining the noted upper outlet 50, and has an outer circumference 90 at housing sidewall 46. Dome cap 60 and upper flange 86 define upper outlet plenum 72 free of a perforated exhaust tube extending axially therethrough and into which exhaust would otherwise have to be re-introduced and which would otherwise increase restriction, for example, in the '215 patent, eliminating re-introduction of exhaust into exhaust tube 15 through perforations 20. Upper outlet plenum 72 unobstructedly fully occupies the lateral cross-sectional area of housing 42, without an exhaust tube, such as 15 of the '215 patent, extending axially therethrough.

External exhaust tube 76 extends upwardly from upper outlet 50 at upper annular flange 86. In one embodiment, a second upper annular flange 92 is spaced above upper annular flange 86 by an axial gap defining an upper annular space 94 axially between flanges 86 and 94 and radially between external exhaust tube 76 and housing sidewall 46. Each of upper annular flanges 86 and 92 has an inner circumference 88 and 96, respectively, mounted to external exhaust tube 76 at axially spaced locations therealong. This is desirable because it provides reinforcement against lever arm bending of exhaust tube 76 or extensions thereof, typically encountered in mounting of the exhaust system and in service during road and/or engine vibration. In a further embodiment, upper annular flange 86 may have one or more openings such as 98 therethrough communicating with upper annular space 94 to provide a resonant chamber in space 94, for cancellation or damping of designated frequencies or harmonics.

In a desirable aspect, the construction of the system separates and spaces first and second tubes 52 and 76, respectively. Second tube 76 is separate from and spaced vertically above first tube 52 by axial gap 58 therebetween defining upper outlet plenum 72 laterally spanning housing 42 above annular space 54 and above top end 56 of first tube 52. Tube 76 extends axially upwardly from the housing for discharging exhaust. Dome cap 60 on top end 56 of tube 52 blocks exhaust flow axially upwardly therepast, such that exhaust flows through the perforated portion of tube 52 as shown at arrow 68 through perforations 62 into annular space 54 then into plenum 72 then to tube 76. Dome cap 60 blocks entry of water axially downwardly therepast into top end 56 of tube 52 from tube 76 thereabove and instead diverts and sheds water radially outwardly into annular space 54. Annular flange 78 extends laterally between first tube 52 and housing sidewall 46 below top end 56 of tube 52 and defines collection space 84 for water shed from dome cap 60 into annular space 54. Flange 78 is preferably at the lower end of tube 52. Housing sidewall 46 has one or more drain holes 100 therethrough above flange 78 for draining water from collection space 84. If moisture collects in space 84 to the level of drain 100, the excess moisture will drain outwardly of sidewall 46.

A portion of the moisture flowing outwardly on dome cap or umbrella 60 may flow inwardly through perforations 62 and along the inner surface of tube 52. This moisture flowing along the inner surface of tube 52 will be directed outwardly through the lowermost row of perforations 102 by a ring 104 secured to the inner surface of tube 52, comparably to ring 22 in the '215 patent. This moisture will then flow along the outer surface of tube 52 and be collected in collection space or trap 84. Most moisture collected in space 84 will drain through hole 100, however when the engine is started, any remaining moisture collected in collection space or trap 84 will be heated and evaporated and the vapor will pass out of the assembly through annular space 54 then upwardly as shown at arrows 70 and 74.

Figure 2:
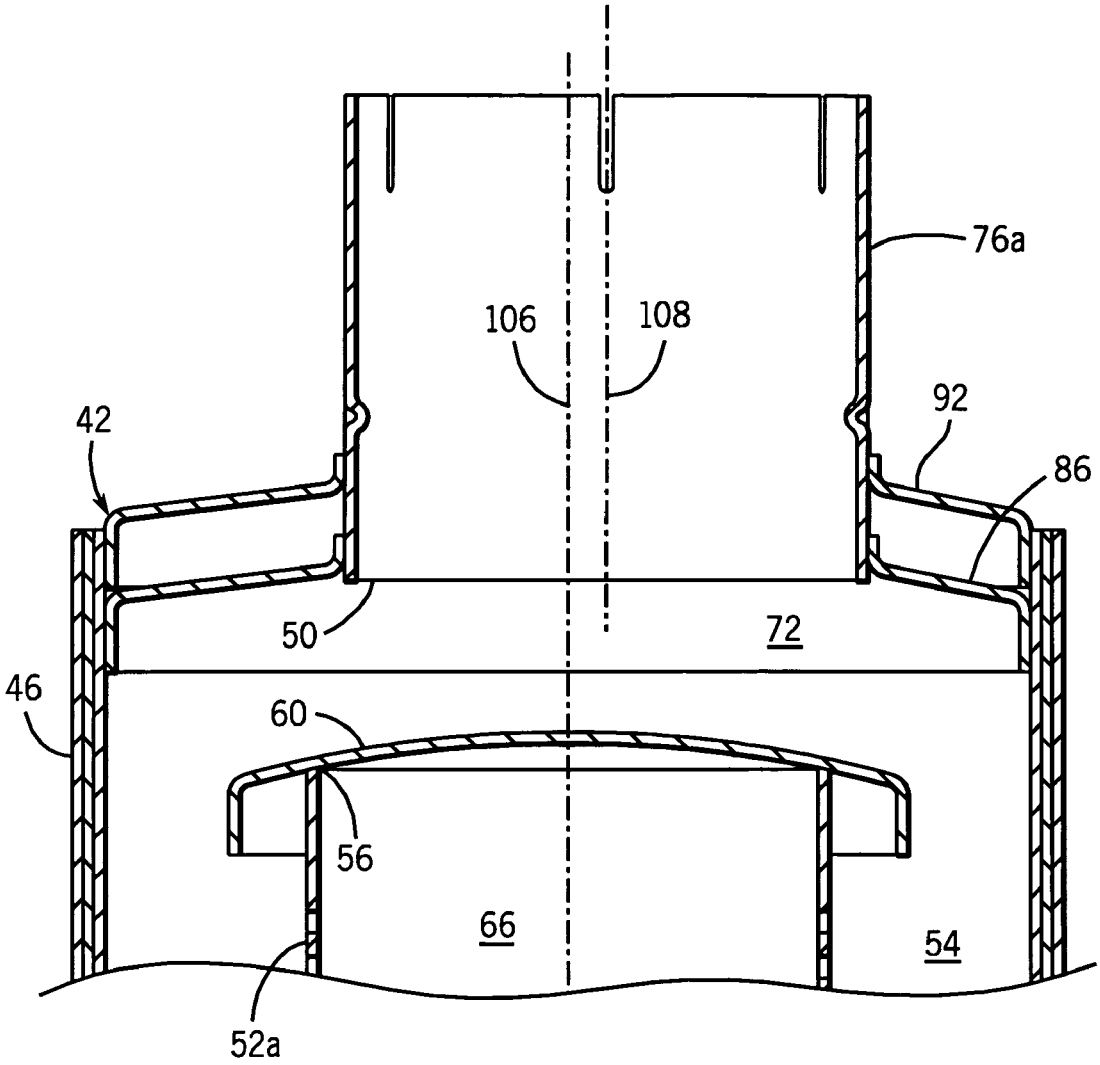

In a desirable aspect, the separation of tubes 52 and 76 (instead of a single tube 15 as in the '215 patent) enables the first tube 52 to have a different diameter than the second tube 76. This is desirable in applications where the second tube 76 is limited or required to be of a certain diameter, e.g. 4", to match system requirements, yet allowing the first tube 52 to be a larger diameter, e.g. 6", to reduce restriction, backpressure, and to improve flow distribution across the catalyst or soot filter. If tubes 52 and 76 are a single unitary tube, then the diameter thereof must match system requirements, including outlet dimensional requirements, which in turn limits the diameter of the internal exhaust tube to a diameter which may unnecessarily introduce restriction or increase backpressure. Different diameter separated tubes 52*a* and 76*a* are illustrated in FIG. 2, which uses like reference numerals from above where appropriate to facilitate understanding.

First tube 52 extends along a first axial centerline, and second tube 76 extends along a second axial centerline. In one embodiment, the noted axial centerlines are axially aligned with each other as shown at 44, FIG. 1. In another embodiment, FIG. 2, the axial centerline 106 of first tube 52*a* is laterally offset from the axial centerline 108 of the second tube 76*a*. This affords packaging flexibility, which has been particularly encountered in various bus applications where the customer has desired such offset for accommodating restricted compartments in the exhaust system.

FIGS. 3-6 show an exhaust water trap assembly 120 including a housing 122 extending axially along a vertical axis 124 and having a housing sidewall 126. The housing has a lower inlet 128 for receiving exhaust as shown at arrows 130 from an internal combustion engine, and an upper outlet 132 for discharging the exhaust and spaced above lower inlet 128. An internal exhaust tube or housing 134 extends upwardly from lower inlet 128 and is spaced radially inwardly of housing sidewall 126 by a radial gap 136 defining an annular space 138 therebetween. Internal exhaust tube or housing 134 houses an exhaust aftertreatment element 140, e.g. a catalyst element and/or particulate soot filter, through which the exhaust flows upwardly. Internal exhaust tube 134 has a top end 142 vertically spaced below upper outlet 132 by an axial gap 144. A dome cap 146 is at the top end 142 of and spans internal exhaust tube 134 and blocks entry of water axially downwardly therepast into top end 142 of internal exhaust tube 134 from upper outlet 132, and instead diverts and sheds the water radially outwardly into annular space 138.

Figure 3:
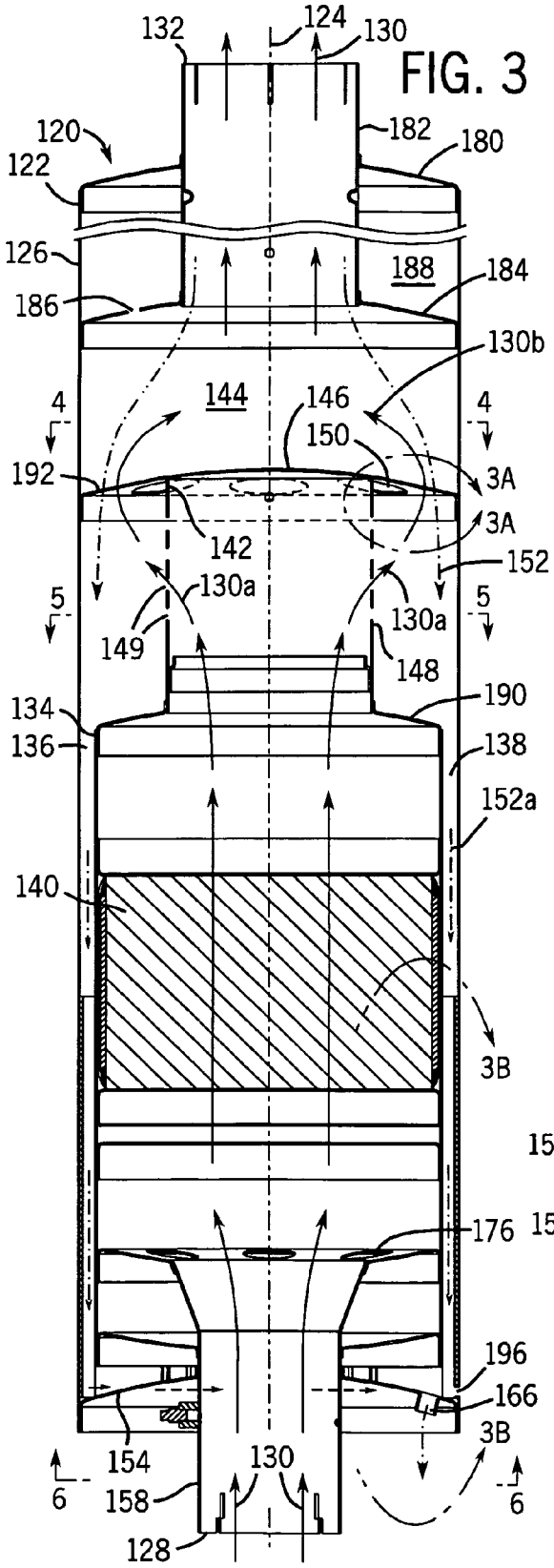

Internal exhaust tube 134 has an upper reduced diameter section 148 which is perforated such that exhaust flows radially outwardly therethrough as shown at arrows 130*a*. Dome cap 146 has a plurality of openings 150 therearound, for example as shown in FIGS. 4 and 3A at 150*a*, 150*b*, etc., through which exhaust flows upwardly as shown at arrows 130*b*, and through which water flows downwardly as shown at arrows 152. The water flows downwardly as shown at arrows 152*a* into annular space 138, FIGS. 3, 3B.

Figure 3B:
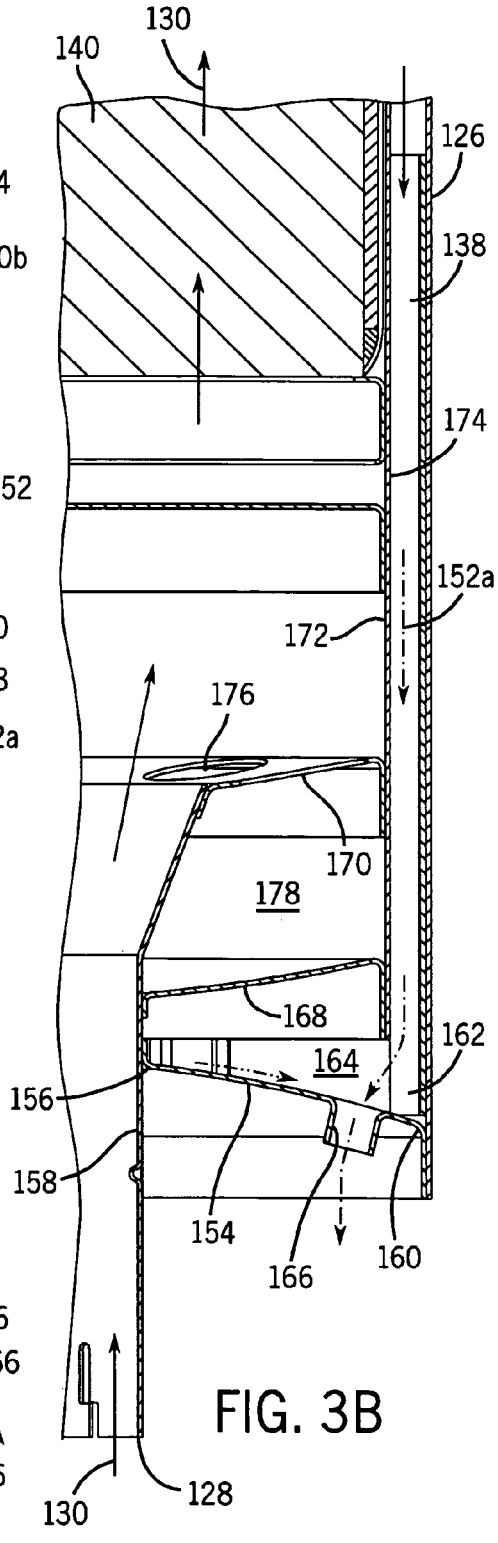
FIG. 3B is an enlarged view taken along line 3B-3B of FIG. 3.
Figure 5:
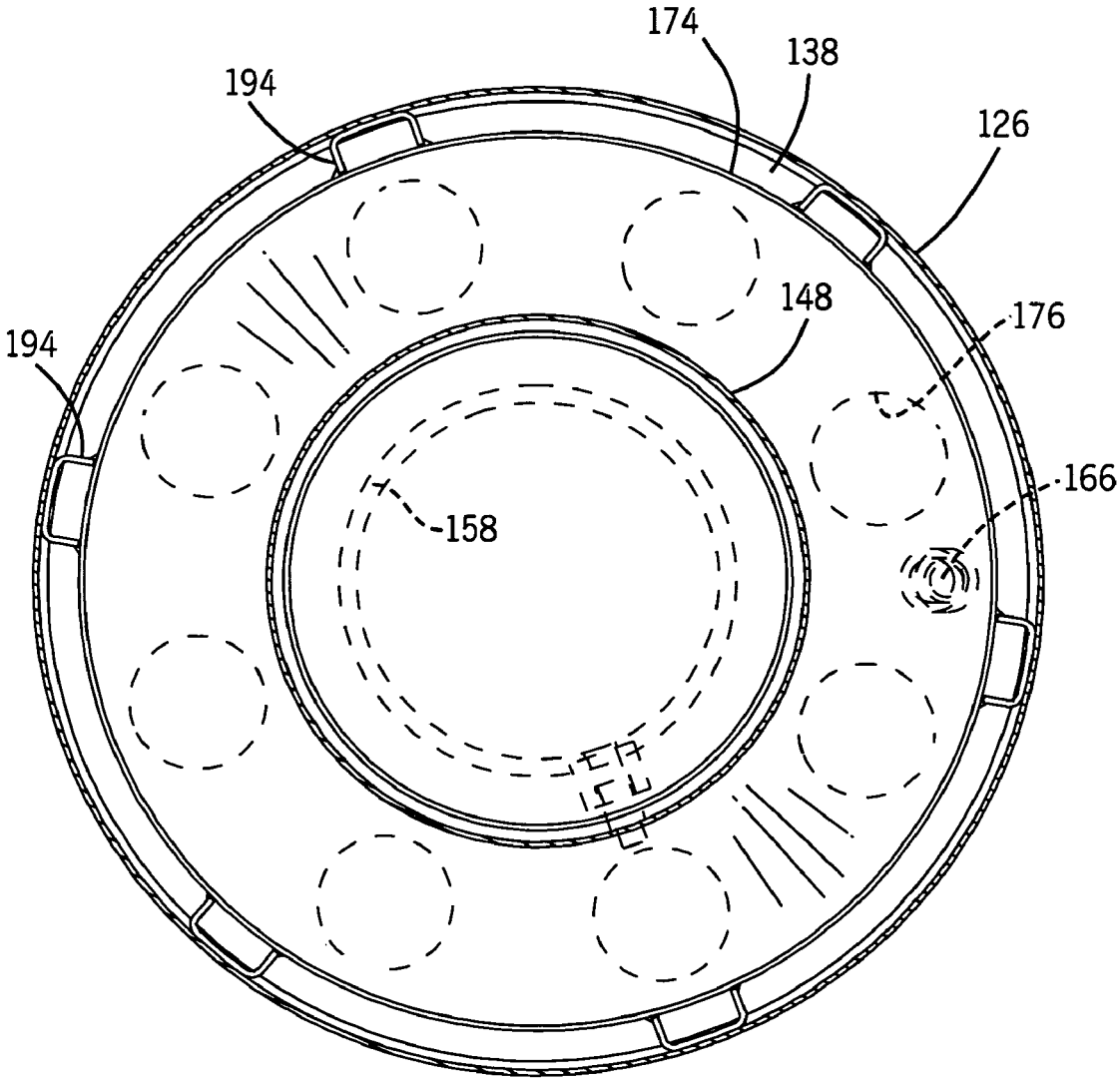
Figure 6:
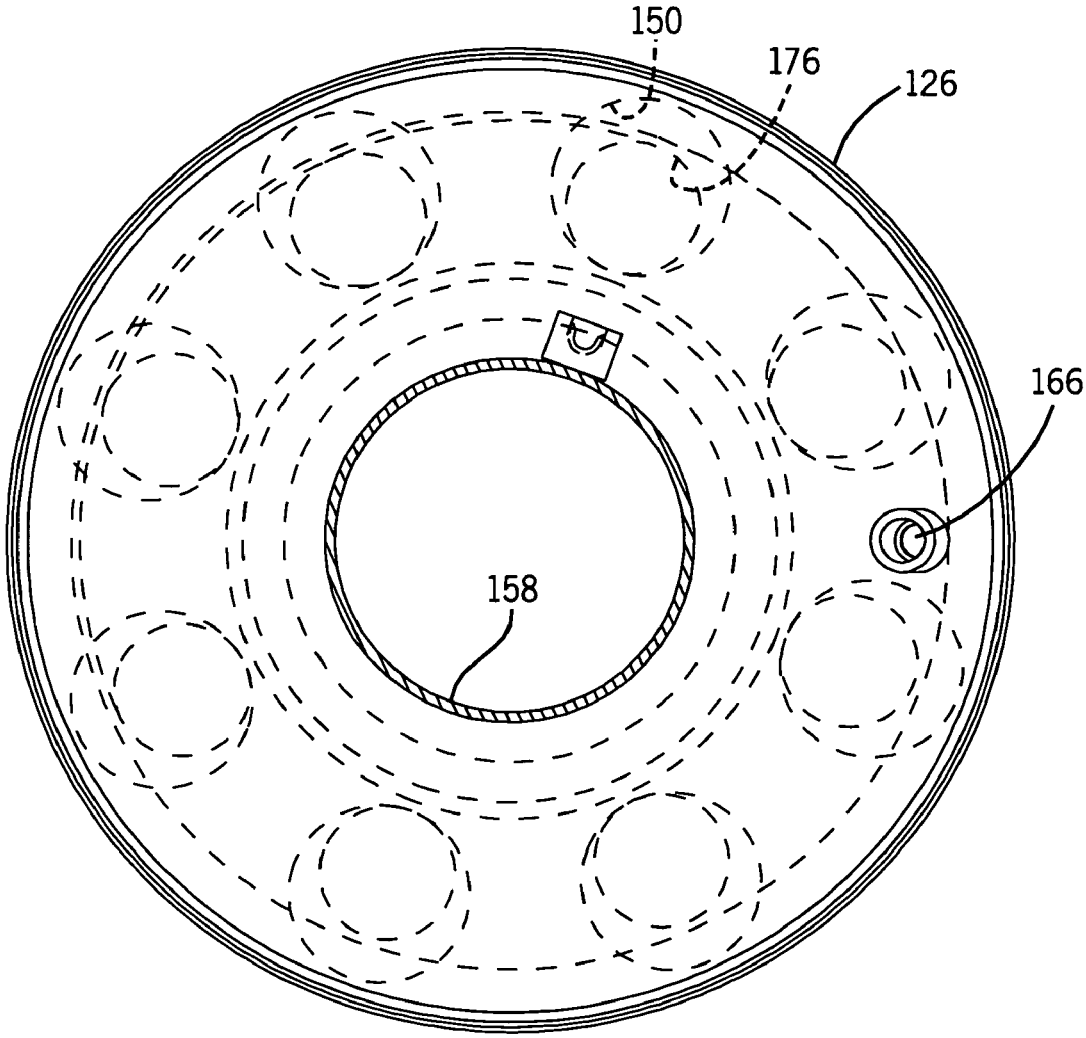

A lower flange 154, FIGS. 3, 3B, has an inner circumference 156 at a lower section 158 of internal exhaust tube 134 and defines the noted lower inlet 128. Flange 154 has an outer circumference 160 at outer housing sidewall 126 and spans and closes annular space 138 at a lower end 162 thereof to form a collection space 164 for the water. One or more drain holes 166 are provided through lower flange 154 for draining water from collection space 164. Flanges 168 and 170 are spaced above flange 154 and extend between lower inlet section 158 of the internal exhaust tube and sidewall 172 of central section 174 of the internal exhaust tube. Flange 170 has one or more openings 176 therethrough communicating with the space 178 between flanges 168 and 170 to provide a resonant chamber in space 178, for cancellation or damping of designated frequencies or harmonics. Water collection space 164 is sealed from resonant chamber 178 by flange 168 therebetween.

An upper annular flange 180, FIG. 3, has an inner circumference at upper outlet tube 182 spaced vertically above top end 142 of internal exhaust tube 134 and dome cap 146 by the noted axial gap 144 and defining the noted upper outlet 132. Flange 180 has an outer circumference at outer housing sidewall 126. Another flange 184 also extends between outlet tube 182 and housing sidewall 126 and is spaced below flange 180. Flange 184 has one or more openings such as 186 therethrough communicating with annular space 188 between flanges 180 and 184 to provide a resonant chamber in space 188, for cancellation or damping of designated frequencies or harmonics. Dome cap 146 and the upper flanges define an upper outlet plenum 144 free of a perforated exhaust tube extending axially therethrough and into which exhaust would otherwise would have to be re-introduced and which would otherwise increase restriction. Upper outlet plenum 144 fully occupies the entire lateral cross-sectional area of the housing without an exhaust tube extending axially therethrough.

Internal exhaust tube 134 has the noted lower section 158 of a first outer circumference and extending axially through lower flange 154 at the latter's inner circumference 156. Internal exhaust tube 134 has the noted middle section 174 of a second outer circumference and extending axially upwardly from lower section 158 and defining at least in part the noted annular space 138 between outer housing sidewall 126 and the noted second outer circumference of middle section 174 at sidewall 172 of internal exhaust tube 134. Internal exhaust tube 134 has the noted upper section 148 of a third outer circumference and extending axially upwardly from middle section 174 and is perforated as shown at 149 to pass exhaust radially outwardly therethrough as shown at arrows 130*a*. The noted second outer circumference of middle section 174 is greater than each of the noted first and third outer circumferences of lower section 158 and upper section 148, respectively. An intermediate annular flange 190, FIG. 3, is axially spaced between upper and lower flanges 180 and 154 and is axially spaced below dome cap 146. Intermediate flange 190 is formed on internal exhaust tube 134 and transitions between the noted second and third outer circumferences and further diverts water into annular space 138. The noted one or more drain holes 166 are through lower flange 154 at lower inlet 128 and drain water from annular space 138 and collection space 164. Intermediate flange 190 has an inner circumference coextensive with the noted third outer circumference of upper section 148. Intermediate flange 190 has an outer circumference coextensive with the noted second outer circumference of middle section 174. Dome cap 146 has an outer circumference 192 greater than the noted third outer circumference at upper section 148 of internal exhaust tube 134. Outer circumference 192 of dome cap 146 is greater than or equal to the noted second outer circumference of middle section 174. Preferably, outer circumference 192 of dome cap 146 is at outer housing sidewall 126, and dome cap 146 has the noted plurality of openings 150 extending axially therethrough and radially spaced between the noted third outer circumference at upper section 148 of internal exhaust tube 134 and outer circumference 192 of dome cap 146. Openings 150 pass exhaust upwardly therethrough and pass water downwardly therethrough, as above noted for example at arrows 130*b* and 152, respectively.

Housing 122 provides a first external housing extending axially along vertical axis 124 and having the noted first housing sidewall 126. Internal exhaust tube 134 provides a second housing within the first housing 122 and concentrically surrounded thereby and extending axially along vertical axis 124. Second internal housing 134 has a housing sidewall 172 spaced radially inwardly of first housing sidewall 126 by the noted radial gap 136 defining the noted annular space 138 therebetween. Second internal housing 134 has the noted lower inlet 128 for receiving exhaust from an internal combustion engine. First outer housing 122 has the noted upper outlet 132 for discharging the exhaust and is spaced above lower inlet 128. The second inner housing includes the noted internal exhaust tube having the noted lower section 158 extending upwardly from lower inlet 128, the noted middle section 174 extending upwardly from lower section 158 and defining at least in part the noted annular space 138, and the noted upper section 148 extending upwardly from middle section 174 and having the noted top end 142 spaced below upper outlet 132 by the noted axial gap 144. Dome cap 146 is provided at the noted top end 142 of and spans upper section 148 of the internal exhaust tube and blocks entry of water axially downwardly therepast into top end 142 of the internal exhaust tube from upper outlet 132 and instead diverts and sheds the water radially outwardly and then through holes 150 into annular space 138. The internal exhaust tube or housing 134 is mounted within outer housing 122 by a plurality of radial spokes or legs 194, FIG. 5, which also maintain the radial gap spacing at 136 to provide annular space 138.

As noted above, exhaust aftertreatment element 140 is housed in second housing 134. The one or more drain holes 166 are at a vertical level below the vertical level of exhaust aftertreatment element 140. As shown in FIG. 3, the one or more drain holes 166 are vertically spaced below exhaust aftertreatment element 140 by a vertical gap therebetween. The one or more drain holes 166 may be provided through lower flange 154, as noted above. Alternatively or additionally, one or more drain holes may be provided through housing sidewall 126, as shown in dashed line at 196. Drain holes 166 may be vertically aligned with exhaust aftertreatment element 140 as shown, and/or may be radially offset therefrom, for example by being vertically aligned with annular space 138. Drain holes 196 are vertically spaced below and radially offset from exhaust aftertreatment element 140.

The above noted inner and outer circumferences of annular space 138 provided by the respective housing sidewalls, and the noted inner and outer circumferences of the respective flanges, may have various shapes including cylindrical shapes, oval shapes, racetrack shapes, and other closed loop configurations. The term annular herein includes such shapes, and the terms inner and outer circumferences include the concording perimeter shapes thereof. Furthermore, respective inner and outer circumferences may or may not have identical shapes, for example an inner circumference may be round while the outer circumference is oval, and vice versa, etc. The inner and outer circumferences may share the same coincident vertical axis, or may have radially or laterally offset axes. The inlet and outlet may share the same coincident vertical axis, or may have different axes, as well as inner and outer circumferences of differing shape and/or alignment. The inlet and outlet may extend vertically parallel to vertical axis 124 as shown, or alternatively may extend radially or laterally through a respective housing sidewall, or may extend at some other angle relative to vertical.

The following description of FIGS. 7-10 is taken from above noted parent U.S. patent application Ser. No. 11/243,694, FIGS. 1-4, respectively.

Figure 7:
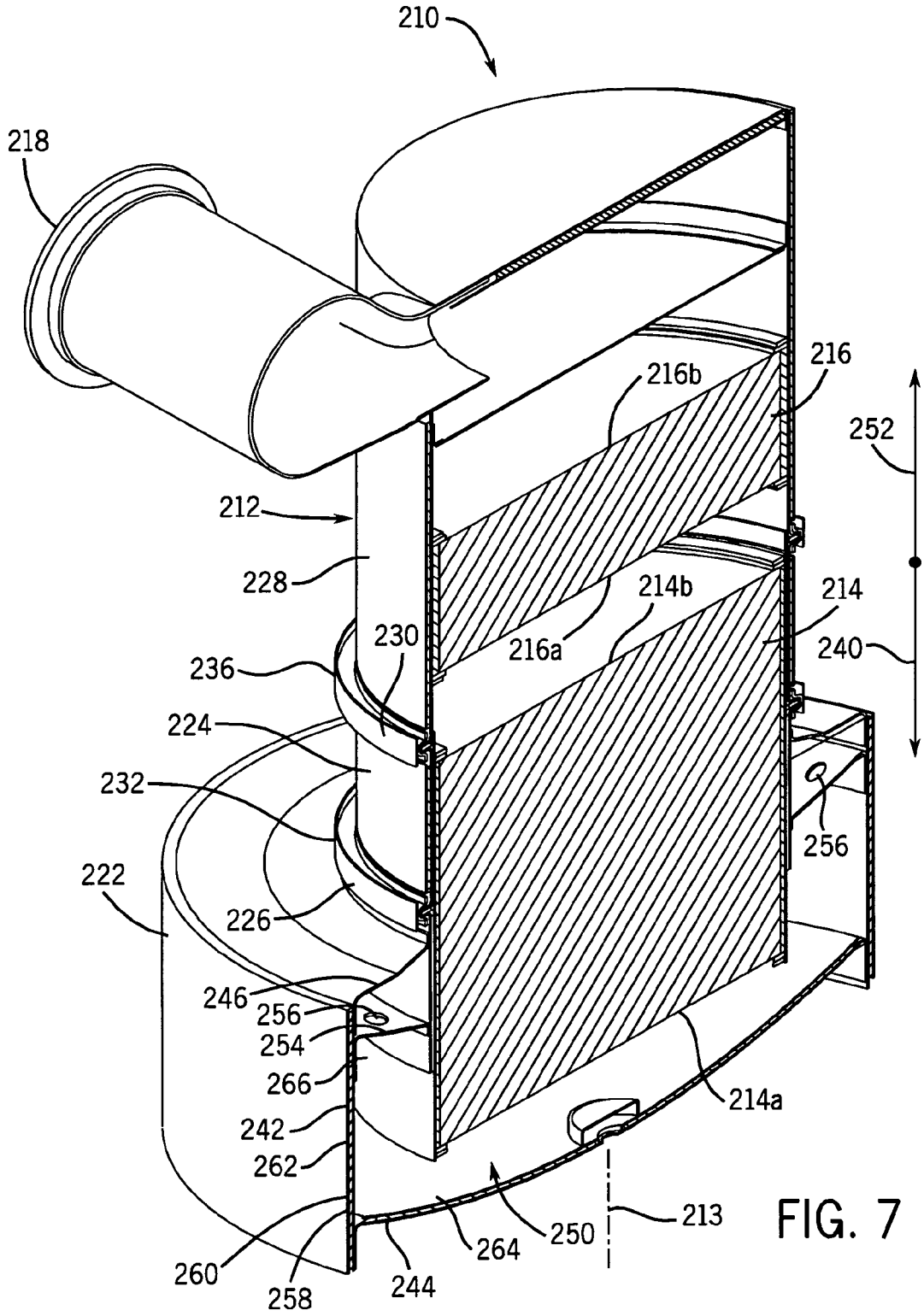
FIGS. 7-10 are taken from above noted parent U.S. patent application Ser. No. 11/243,694.
Figure 8:
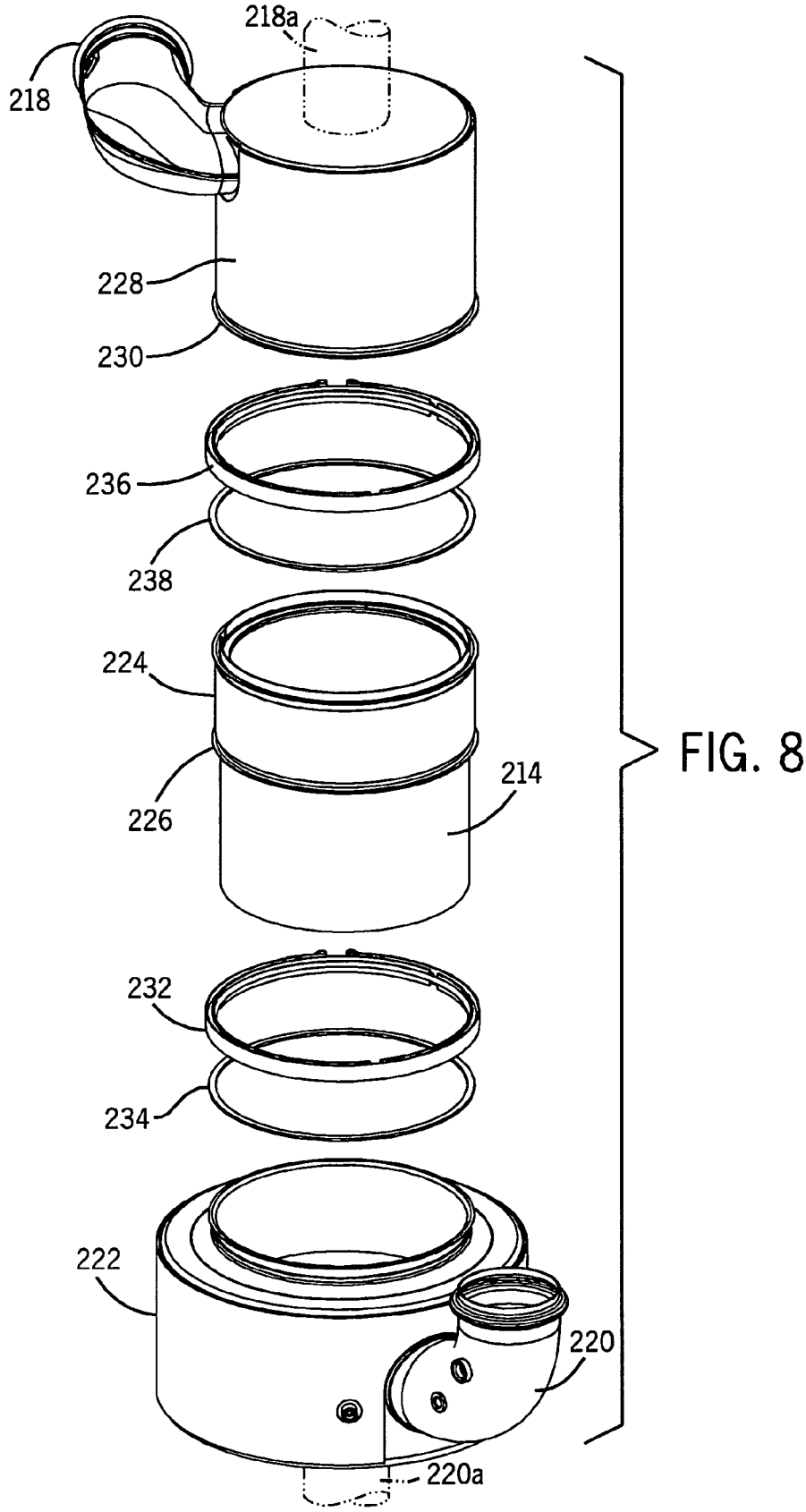

FIGS. 7, 8 show an aftertreatment exhaust assembly 210 having a housing 212 extending axially along axis 213 and containing an aftertreatment element, for example one or both of a particulate soot filter 214 and a catalyst element 216. The housing has an inlet 218 and an outlet 220 communicating respectively with distally opposite axial ends 214*a* and 214*b* of aftertreatment element 214, and 216*a* and 216*b* of aftertreatment element 216. Exhaust flows from inlet 218 then axially through aftertreatments element 216, 214 then to outlet 220. The housing has housing sections 222 and 224 meeting at a junction at joint 226 axially between axial ends 214*a* and 214*b* of aftertreatment element 214. The housing has housing sections 224 and 228 meeting at junction 230 axially between aftertreatment elements 214 and 216. Alternatively, joint 230 may be axially between axial ends 216*a* and 216*b* of aftertreatment element 216.

Joint 226 is a service joint. Housing sections 222 and 224 are separable from each other at service joint 226 such that upon separation of housing sections 222 and 224, axial end 214*a* of aftertreatment element 214 is axially spaced beyond housing section 224, and the aftertreatment element is readily accessible, for ease of servicing, e.g. cleaning. During such servicing, aftertreatment element 214 will typically, though not necessarily, remain attached to housing section 224, e.g. by welding. Connection 232 connects housing sections 222 and 224 to each other at service joint 226. In one form, the connection 232 is a band clamp known in the prior art, e.g. an inverted truncated V-shape band clamp, though other types of connections may be used, for example a bolted flange connection, or other typical arrangements for connecting housing or body sections. In some embodiments, a gasket 234 is provided between housing sections 222 and 224 at joint 226. A connection 236 connects housing sections 224 and 228 to each other at joint 230, which connection may be a band clamp, e.g. the noted standard inverted truncated V-shape type clamp, or other connections, as noted. In some embodiments a gasket 238 is provided between housing sections 224 and 228 at joint 230. Inlet 218 may extend radially from the housing as shown, or alternatively the inlet may extend axially from the housing as shown in dashed line at 218*a*. Outlet 220 may extend radially from the housing as shown, or alternatively may extend axially from the housing as shown in dashed line at 220*a*.

In FIGS. 7, 8, housing section 222 is an outlet housing section. Aftertreatment element 214 extends axially into outlet housing section 222 along a first axial direction 240, and has an outlet axial end 214*a* within outlet housing section 222. Outlet housing section 222 has a sidewall 242 extending axially between first and second end walls 244 and 246 and of larger diameter than aftertreatment element 214 and providing an outlet plenum 250 of reduced restriction. End wall 244 of outlet housing section 222 is axially spaced from outlet axial end 214*a* of aftertreatment element 214 along the noted first axial direction 240. End wall 246 of outlet housing section 222 is axially spaced from outlet axial end 214*a* of aftertreatment element 214 along a second axial direction 252, which second axial direction 252 is opposite to the noted first axial direction 240. An inner end wall 254 may be provided in outlet housing section 222, which end wall 254 may be perforated or otherwise have apertures such as 256 therethrough for forming a resonant chamber between end walls 254 and 246 for resonant tuning purposes. In further embodiments, an enlarged reduced restriction inlet plenum is provided in addition to or instead of outlet plenum 250.

Sidewall 242 of outlet housing section 222 has a first span 258 extending from end wall 244 axially along the noted second axial direction 252 to a midpoint 260 radially aligned with outlet axial end 214*a* of aftertreatment element 214. Sidewall 242 has a second span 262 extending from midpoint 260 axially along the noted second axial direction 252 to end wall 246. Span 258 and end wall 244 define an open volume first plenum section 264 at outlet axial end 214*a* of aftertreatment element 214 and extending axially along the noted first axial direction 240 therefrom. Span 262 and end wall 246 define an annular volume second plenum section 266 at outlet axial end 214*a* of aftertreatment element 214 and extending axially along the noted second axial direction 252 therefrom and in circumscribing relation to aftertreatment element 214. In one embodiment, the axial length of second span 262 is greater than the axial length of first span 260 to reduce and save space at outlet axial end 214*a* of aftertreatment element 214 along the noted first axial direction 240 therefrom and reduce the amount of axial extension of housing 212 in the noted first axial direction 240 beyond outlet axial end 214*a* of aftertreatment element 214. Further in the preferred embodiment, sidewall 242 of outlet housing section 222 is of larger diameter than housing section 224.

Outlet 220 is provided by an outlet tube extending radially from outlet housing section 222 at any desired circumferential position therearound, which is an advantage for accommodating different engine compartment requirements. In one embodiment, outlet tube 220 is radially aligned with outlet axial end 214*a* of aftertreatment element 214. Joint 230 is axially spaced from joint 226 by housing section 224 therebetween. Inlet 218 communicates with housing section 228, and outlet 220 communicates with housing section 222. Joint 230 is axially between joint 226 and inlet 218. Joint 230 is axially spaced from joint 226 on the opposite axial side thereof from end 214*a* of aftertreatment element 214. Joint 230 is slightly axially spaced from aftertreatment element 214. Housing section 224 axially spans axial end 214*b* of aftertreatment element 214. Axial end 214*b* of aftertreatment element 214 is axially between joints 226 and 230.

Figure 9:
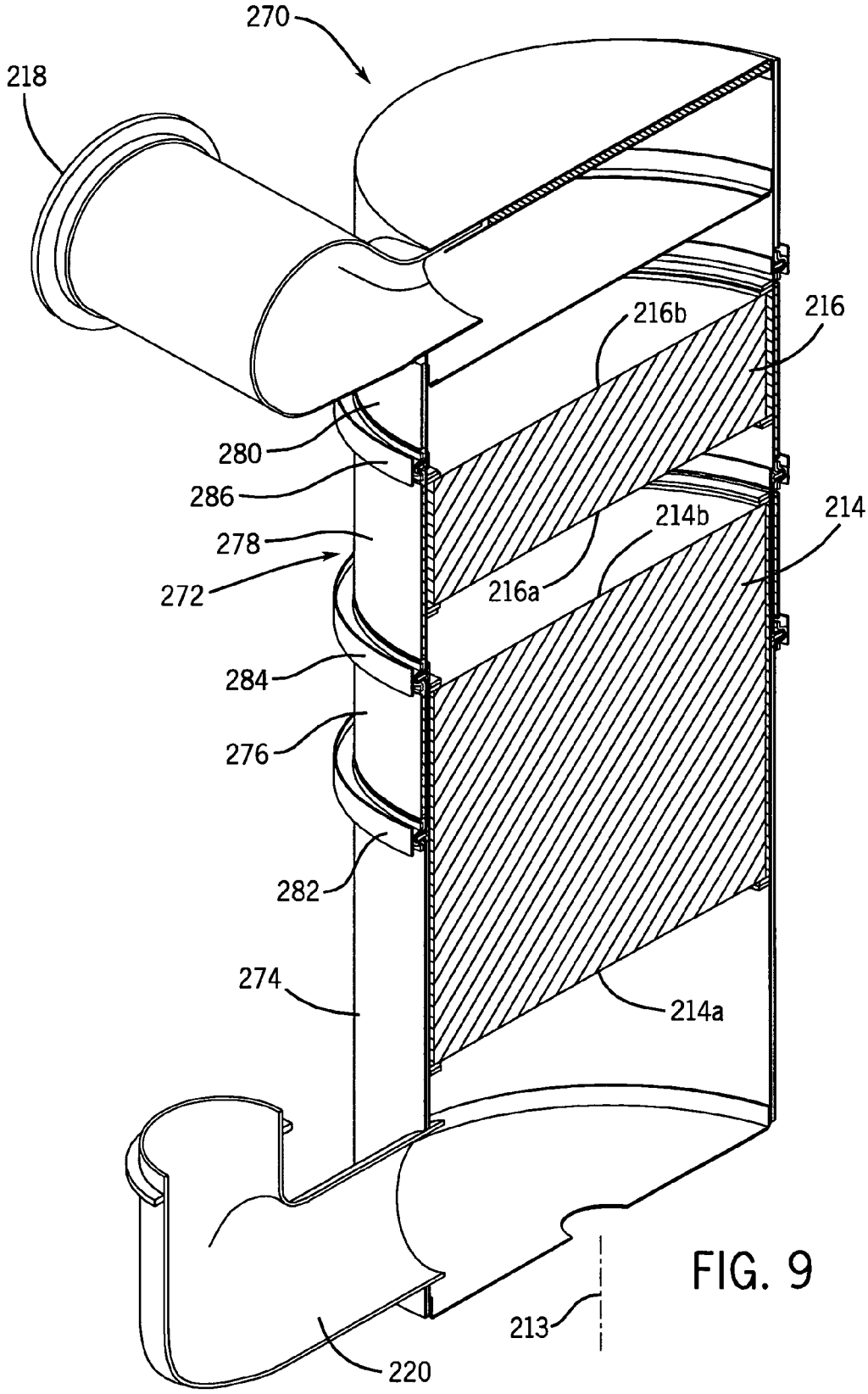
Figure 10:
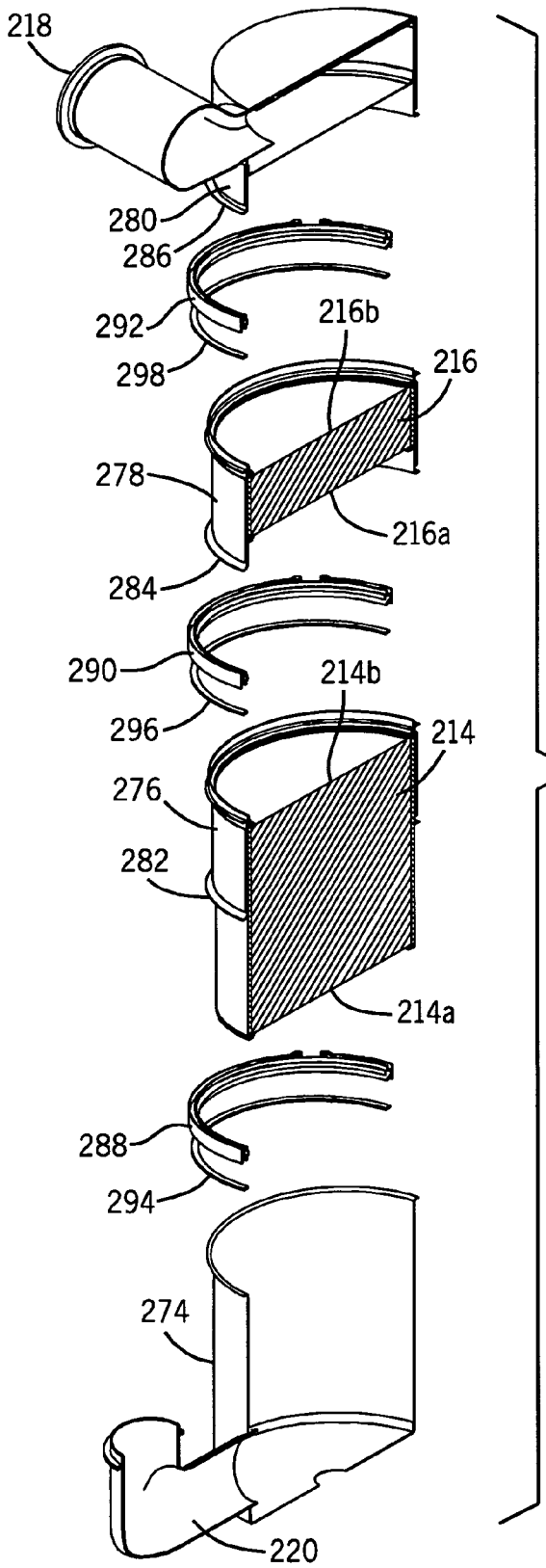

FIGS. 9, 10 show another embodiment and use like reference numerals from above where appropriate to facilitate understanding. Aftertreatment exhaust assembly 270 includes a housing 272 extending axially along axis 213 and containing at least one aftertreatment element, and in some embodiments two aftertreatment elements, namely a particulate soot filter 214 and a catalyst element 216. The housing has an inlet 218 and an outlet 220 communicating respectively with axially distally opposite axial ends of the aftertreatment elements. Exhaust flows from inlet 218 then axially through the aftertreatment elements then to outlet 220. The housing has first, second, third and fourth sections 274, 276, 278, 280. First and second housing sections 274 and 276 meet at a first joint 282. Second and third housing sections 276 and 278 meet at second joint 284. Third and fourth housing sections 278 and 280 meet at a third joint 286. Joint 282 is axially between axial ends 214*a* and 214*b* of aftertreatment element 214. Respective housing sections 274 and 276 on opposite axial sides of joint 282 are separable from each other at joint 282 such that upon separation of respective housing sections 274 and 276 the noted axial end 214*a* of aftertreatment element 214 extends axially beyond housing section 276, and the aftertreatment element is readily accessible for ease of servicing.

In FIGS. 9, 10, joint 284 is axially spaced from joint 282 on the opposite axial side thereof from axial end 214*a* of aftertreatment element 214. Joint 284 is slightly axially spaced from aftertreatment element 214. Alternatively, joint 284 may be axially between axial ends 216*a* and 216*b* of aftertreatment element 216. Housing section 276 axially spans axial end 214*b* of aftertreatment element 214. Inlet 218 is at housing section 280, and outlet 220 is at housing section 274, though this arrangement may be reversed. The joints may be clamped by respective connections, e.g. band clamps 288, 290, 292, as above, and may have respective gaskets 294, 296, 298 between respective housing sections, as above.

The systems provide a method for servicing an aftertreatment exhaust assembly comprising providing a joint as a service joint, as noted, at a location axially between the axial ends 214*a* and 214*b* of the aftertreatment element 214, and separating the housing sections 222 and 224, 274 and 276, from each other at the service joint 226, 282, such that upon separation of the noted housing sections, axial end 214*a* of the aftertreatment element 214 is axially spaced beyond the housing section 224, 276, and servicing the aftertreatment element 214. The system also provides a method for saving space in an aftertreatment exhaust assembly comprising providing an outlet housing section 222 wherein the aftertreatment element 214 extends axially into such outlet housing section 222, with the outlet axial end 214*a* of the aftertreatment element 214 being within outlet housing section 222, and providing the outlet housing section 222 with a sidewall 242 extending axially between first and second end walls 244 and 246 and of larger diameter than the aftertreatment element 214 and providing an outlet plenum 250 of reduced restriction and reduced axial extension along the noted first axial direction from the outlet axial end 214*a* of the aftertreatment element 214. The method further involves providing the joint 226 at a location axially between the axial ends 214*a* and 214*b* of the aftertreatment element 214. The method further involves spacing the first end wall 244 of the outlet housing section 222 axially from the outlet axial end 214*a* of the aftertreatment element 214 along the noted first axial direction 240, spacing the second end wall 246 and/or 254 of the outlet housing section 222 axially from the outlet axial end 214*a* of the aftertreatment element 214 along the noted second axial direction 252, providing the sidewall 242 of the outlet housing section 222 with a first span 258 extending from first end wall 244 axially along the noted second axial direction 252 to a midpoint 260 radially aligned with the outlet axial end 214*a* of the aftertreatment element 214, providing the sidewall 242 of the outlet housing section 222 with a second span 262 extending from the midpoint 260 axially along the noted second axial direction 252 to the noted second end wall 246, providing the first span 258 and the first end wall 244 defining an open volume first plenum section 264 at the outlet axial end 214*a* of the aftertreatment element 214 and extending axially along the noted first axial direction 240 therefrom, providing the second span 262 and the second end wall 246 defining an annular volume second plenum section 266 at the outlet axial end 214*a* of the aftertreatment element 214 and extending axially along the noted second axial direction 252 therefrom and in circumscribing relation to the aftertreatment element 214. The method further involves providing the second span 262 of greater axial length than the first span 258 to reduce and save space at the outlet axial end 214*a* of the aftertreatment element 214 along the noted first axial direction 240 therefrom and reduce the amount of axial extension of the housing 212 in the noted first axial direction 240 beyond the outlet axial end 214*a* of the aftertreatment element 214.

Figure 11:
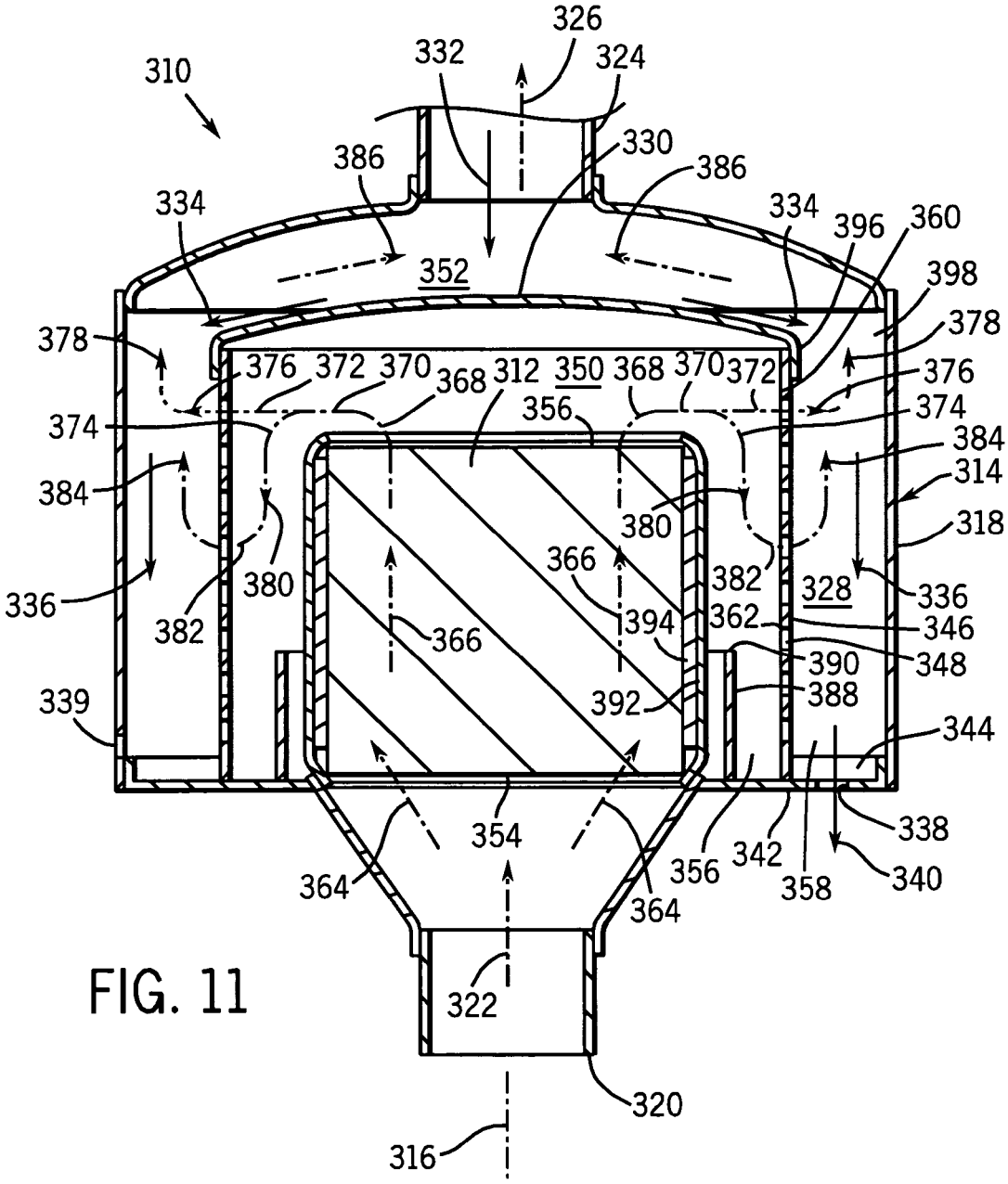
FIG. 11 is a side sectional view of a combination exhaust muffler and aftertreatment element and water trap assembly in accordance with the invention.

FIG. 11 shows a combination exhaust muffler and aftertreatment element and water trap assembly 310. The aftertreatment element 312 is selected from the group consisting of at least one of a catalyst element and a particulate soot filter. Assembly 310 includes a housing 314 extending axially along a vertical axis 316 and having a housing sidewall 318. The housing has a lower inlet 320 for receiving exhaust as shown at arrow 322 from an internal combustion engine, and has an upper outlet 324 for discharging the exhaust as shown at arrow 326 and spaced above lower inlet 320. Aftertreatment element 312 is housed in the housing and spaced radially inwardly of housing sidewall 318 by a radial gap 328 defining an annular space therebetween, which annular shape may be circular, oval, racetrack shaped, obround, or other closed-loop shapes. A dome cap 330 is provided in the housing above aftertreatment element 312 and below upper outlet 324 and blocks entry of water as shown at arrow 332 downwardly therepast into aftertreatment element 312 from upper outlet 324 and instead diverts and sheds the water radially outwardly as shown at arrows such as 334 into annular space 328. The water flows axially downwardly as shown at arrows such as 336 in annular space 328, and is drained from annular space 328 by one or more drain holes 338 as shown at arrow 340. The housing has a lower flange 342 spanning and closing annular space 328 to form a collection space 344 for the water. The one or more drain holes such as 338 are formed through lower flange 342. Alternatively or additionally, one or more drain holes such as 339 may be formed through housing sidewall 318.

In FIG. 11, a perforated tube 346, having perforations as shown at 348, extends axially in the housing between lower flange 342 and dome cap 330 and through which exhaust flows radially outwardly through perforations 348. Perforated tube 346 is in annular space 328 and is radially between aftertreatment element 312 and housing sidewall 318. Dome cap 330 is axially spaced above aftertreatment element 312 by a first axial gap 350, and is axially spaced below upper outlet 324 by a second axial gap 352. Aftertreatment element 312 has an inlet face 354 facing axially downwardly toward lower inlet 320, and has an outlet face 356 facing axially upwardly toward dome cap 330 and axially spaced therebelow by axial gap 350. Perforated tube 346 divides annular space 328 into a first annular subspace 356 and a second annular subspace 358. Perforated tube 346 is radially spaced outwardly of aftertreatment element 312 by first annular subspace 356 therebetween. Housing sidewall 318 is radially spaced outwardly of perforated tube 346 by second annular subspace 358 therebetween.

Perforated tube 346 has a first axial extension portion 360 horizontally aligned with axial gap 350 above outlet face 356 of aftertreatment element 312. Perforated tube 346 has a second axial extension portion 362 below first axial extension portion 360 and horizontally aligned with aftertreatment element 312 below outlet face 356 thereof. Exhaust flows upwardly as shown at 322 through aftertreatment element 312 as shown at arrows such as 364 from inlet face 354 then upwardly as shown at arrows 366 to outlet face 356 then axially upwardly as shown at arrows 368 into axial gap 350 then radially outwardly as shown at arrows 370 in first axial gap 350 then along first and second branches as shown at arrows 372 and 374. First branch 372 extends radially outwardly as shown at arrow 376 through first axial extension portion 360 of perforated tube 346 then axially upwardly as shown at arrows 378 in second annular subspace 358. Second branch 374 extends axially downwardly as shown at arrows 380 in first annular subspace 356 then radially outwardly as shown at arrows 382 through second axial extension portion 362 of perforated tube 346 then axially upwardly as shown at arrows 384 in second annular subspace 358 and rejoining the noted first branch. The exhaust then flows as shown at arrows 386 radially inwardly in axial gap 352 and exits at upper outlet 324 as shown at arrow 326. The noted second branch 374 provides double flow reversal from outlet face 356 of aftertreatment element 312 to first annular subspace 356 to second annular subspace 358, i.e. a first flow reversal from upward axial flow 368 to downward axial flow 380, and a second flow reversal from downward axial flow 380 to upward axial flow 384.

A dam 388, FIG. 11, is provided in first annular subspace 356 between aftertreatment element 312 and perforated tube 346. Dam 388 circumscribes aftertreatment element 312 and extends axially upwardly from lower flange 342 to an upper axial end 390 below outlet face 356 of aftertreatment element 312. Dam 388 blocks water flow to aftertreatment element 312. The one or more drain holes 338 are radially outward of dam 388. An extension wall 392 circumscribes and extends axially along aftertreatment element 312 and may include the above noted mounting mat 394, such as vermiculite, therebetween. Extension wall 392 is radially between aftertreatment element 312 and dam 388. Extension wall 392 extends axially upwardly beyond dam 388 toward outlet face 56 and in one embodiment along the entire length of aftertreatment element 312. In an alternate embodiment, dam 388 is eliminated, and wall 392 acts as the water dam. In FIG. 11, dome cap 330 has an outer circumference 396 spaced radially inwardly of housing sidewall 318 by a radial gap 398 axially above and axially aligned with annular space 328. Outer circumference 396 is at perforated tube 346.

Figure 13:
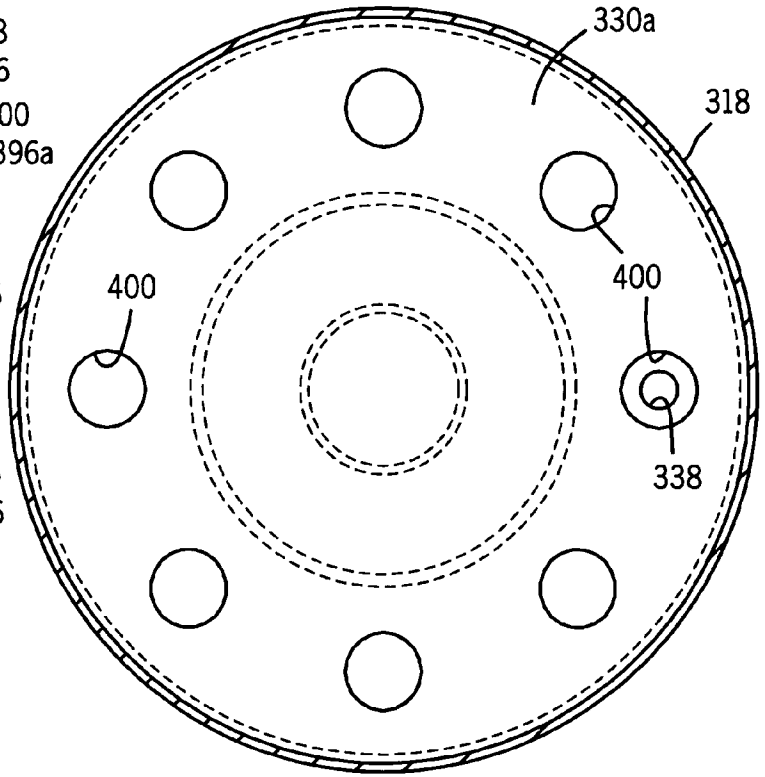
FIG. 13 is a sectional view taken along line 13-13 of FIG. 12.
Figure 12:
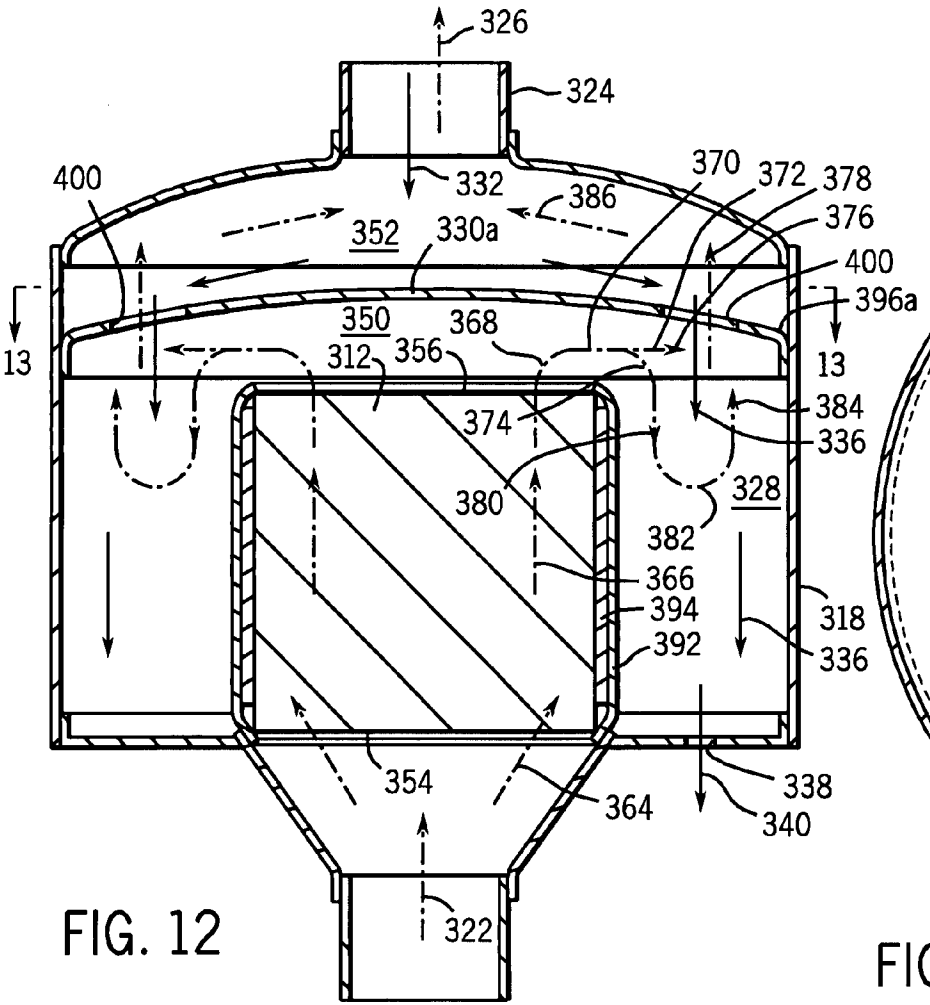
FIG. 12 is like FIG. 11 and shows another embodiment.

FIGS. 12, 13 show another embodiment and use like reference numerals from above where appropriate to facilitate understanding. In FIGS. 12, 13, dome cap 330*a* has an outer circumference 396*a* at housing sidewall 318, and has a plurality of perimeteral apertures such as 400 axially above and axially aligned with annular space 328. As in FIG. 11, exhaust in FIG. 12 flows axially upwardly through aftertreatment element 312 from inlet face 354 to outlet face 356 then axially upwardly at 368 into axial gap 350 then radially outwardly at 370 then in a loop extending axially downwardly at 380 in the noted annular space then radially outwardly at 382 in the annular space then axially upwardly at 384 in the annular space, providing double flow reversal from outlet face 356 of aftertreatment element 312 from upward axial flow 368 to downward axial flow 380 to upward axial flow 384. The exhaust also flows radially outwardly as shown at 376.

Figure 14:
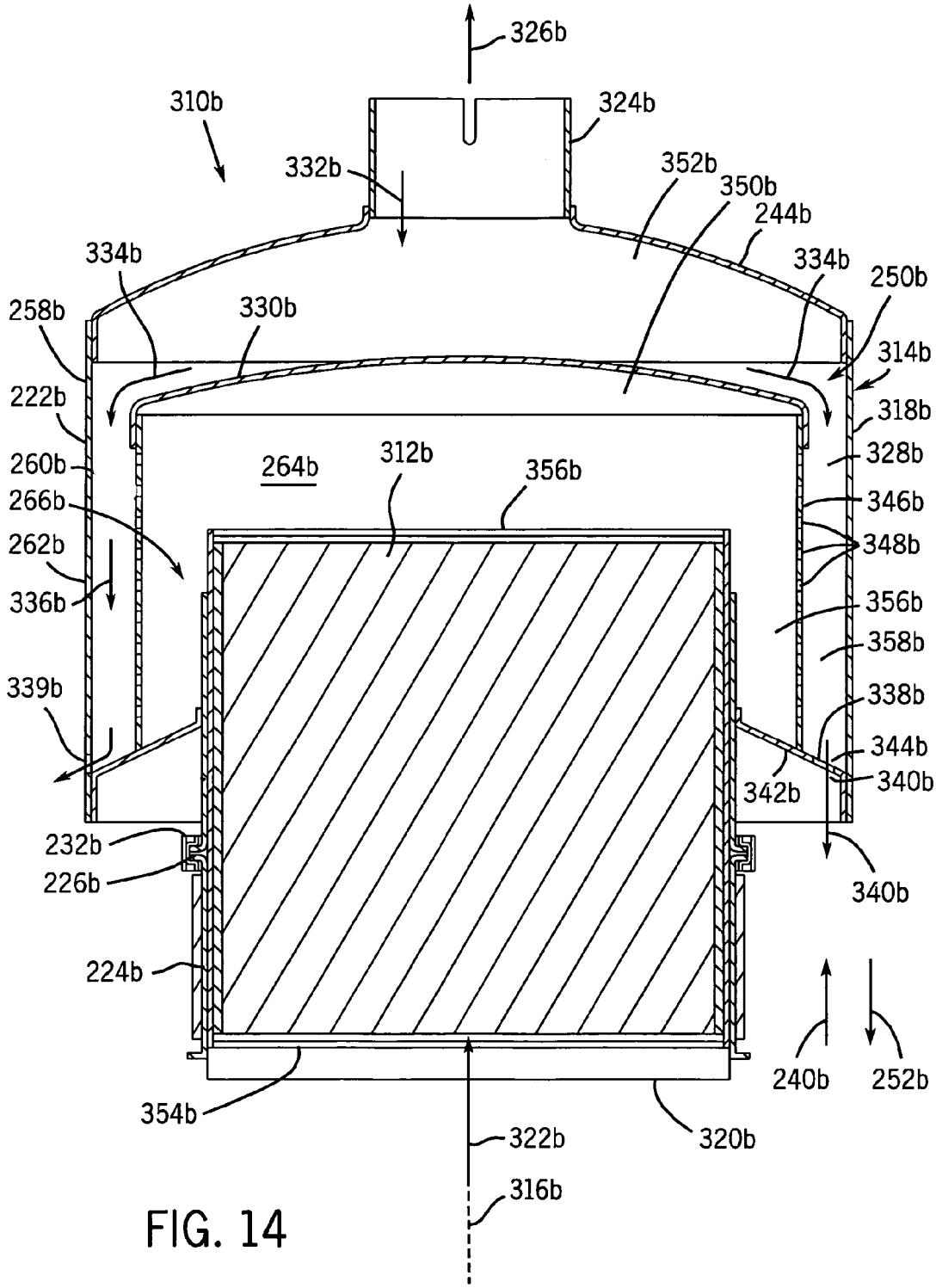
FIG. 14 is like FIG. 11 and shows a further embodiment.

FIG. 14 shows a further embodiment, and uses like reference numerals from above, with the postscript "b", to facilitate understanding. Combination exhaust muffler and aftertreatment element and water trap assembly 310*b* includes aftertreatment element 312*b* selected from the group consisting of at least one of a catalyst element and a particulate soot filter. Assembly 310*b* includes housing 314*b* extending vertically along vertical axis 316*b* and having a housing sidewall 318*b*. The housing has a lower inlet 320*b* for receiving exhaust as shown at arrow 322*b* from an internal combustion engine, and has an upper outlet 324*b* for discharging the exhaust as shown at arrow 326*b* and spaced above lower inlet 320*b*. Aftertreatment element 312*b* is housed in the housing and spaced radially inwardly of housing sidewall 318*b* by radial gap 328*b* defining an annular space therebetween, which annular shape may be circular, oval, racetrack shaped, obround, or other closed-loop shapes. A dome cap 330*b* is provided in the housing above aftertreatment element 312*b* and below upper outlet 324*b* and blocks entry of water as shown at arrow 332*b* downwardly therepast into aftertreatment element 312*b* from upper outlet 324*b* and instead diverts and sheds the water radially outwardly as shown at arrows 334*b* into annular space 328*b*. The water flows axially downwardly as shown at arrow 336*b* in annular space 328*b*, and is drained from annular space 328*b* by one or more drain holes 338*b* as shown at arrow 340*b*. The housing has a lower flange 342*b* spanning and closing annular space 328*b* to form a collection space 344*b* for the water. The one or more drain holes such as 338*b* are formed through lower flange 342*b*. Alternatively or additionally, one or more drain holes such as 339*b* may be formed through housing sidewall 318*b*.

Lower inlet 320*b* and upper outlet 324*b* of housing 314*b* communicate respectively with axially distally opposite ends of aftertreatment element 312*b*, namely lower inlet face 354*b* and upper outlet face 356*b*. The housing has first and second housing sections 222*b* and 224*b* meeting at a joint 226*b* axially between axial ends 354*b* and 356*b* of aftertreatment element 312*b*. Joint 226*b* is a service joint. Housing sections 222*b* and 224*b* are separable from each other at service joint 226*b* such that upon separation of housing sections 222*b* and 224*b*, one of the axial ends 354*b* and 356*b* of the aftertreatment element is axially spaced beyond one of the separated housing sections 222*b* and 224*b*, such that aftertreatment element 312*b* is readily accessible for ease of servicing, e.g. cleaning. During such servicing, aftertreatment element 312*b* will typically, though not necessarily, remain attached to one of the housing sections 222*b* or 224*b*, e.g. by welding. A connection 232*b*, comparable to above noted connection 232, connects housing sections 222*b* and 224*b* to each other at service joint 226*b*. In one form, the connection 232*b* is a band clamp known in the prior art, e.g. an inverted truncated V-shape band clamp, though other types of connections may be used, for example a bolted flange connection, or other typical arrangements for connecting housing or body sections, as above noted. In some embodiments, a gasket comparable to gasket 238 may be provided between the housing sections, as above.

In FIG. 14, housing section 222*b* is an outlet housing section. Aftertreatment element 312*b* extends axially into outlet housing section 222*b* along a first axial direction 240*b*, and has an outlet axial end 356*b* within outlet housing section 222*b*. Outlet housing section 222*b* has a sidewall 318*b* extending axially between first and second end walls 244*b* and 342*b* and of larger diameter than aftertreatment element 312*b* and providing an outlet plenum 250*b*. End wall 244*b* of outlet housing section 222*b* is axially spaced from outlet axial end 356*b* of aftertreatment element 312*b* along the noted first axial direction 240*b*. End wall 342*b* of outlet housing section 222*b* is axially spaced from outlet axial end 356*b* of aftertreatment element 312*b* along a second axial direction 252*b*, which second axial direction 252*b* is opposite to the noted first axial direction 240*b*. Sidewall 318*b* of outlet housing section 222*b* has a first span 258*b* extending from end wall 244*b* to a midpoint 260*b* radially aligned with outlet axial end 356*b* of aftertreatment element 312*b*. Sidewall 318*b* has a second span 262*b* extending from midpoint 260*b* axially along the noted second axial direction 252*b* to end wall 342*b*. Span 258*b* and end wall 244*b* define an open volume first plenum section 264*b* at outlet axial end 356*b* of aftertreatment element 312*b* and extending axially along the noted first axial direction 240*b* therefrom and which may include dome cap 330*b* extending thereacross to also define plenum 352*b*. Span 262*b* and end wall 342*b* define an annular volume second plenum section 266*b* at outlet axial end 356*b* of aftertreatment element 312*b* and extending axially along the noted second axial direction 252*b* therefrom and in circumscribing relation to aftertreatment element 312*b*. The noted second end wall is provided by the noted lower flange 342*b* spanning and closing annular volume plenum section 266*b* and annular space 328*b* to form collection space 344*b* for the water as diverted at 334*b*. The noted one or more drain holes 338*b* and/or 339*b* are formed through at least one of lower flange 342*b* and housing sidewall 318*b*. In one embodiment, the axial length of second span 262*b* may be greater than the axial length of first span 258*b* to reduce and save space at outlet axial end 356*b* of aftertreatment element 312*b* along the noted first axial direction 240*b* therefrom and reduce the amount of axial extension of housing 314*b* in the noted first axial direction 240*b* beyond outlet axial end 356*b* of aftertreatment element 312*b*. In the preferred embodiment, sidewall 318*b* of outlet housing section 222*b* is of larger diameter than housing section 224*b*.

In FIG. 14, a perforated tube 346*b*, having perforations as shown at 348*b*, extends axially in the housing between lower flange 342*b* and dome cap 330*b* and through which exhaust flows radially outwardly through perforations 348*b*. Perforated tube 346*b* is in annular space 328*b* and annular volume plenum 266*b* and is radially between aftertreatment element 312*b* and housing sidewall 318*b*. Dome cap 330*b* is axially spaced above aftertreatment element 312*b* by a first axial gap

350*b*, and is axially spaced below upper outlet 324*b* by a second axial gap 352*b*. Aftertreatment element 312*b* has the noted inlet face 354*b* facing axially downwardly, and has the noted outlet face 356*b* facing axially upwardly toward dome cap 330*b* and axially spaced therebelow by axial gap 350*b*. Perforated tube 346*b* divides annular space 328*b* into a first annular subspace 356*b* and a second annular subspace 358*b*. Perforated tube 346*b* is spaced radially outwardly of aftertreatment element 312*b* by first annular subspace 356*b* therebetween. Housing sidewall 318*b* is radially spaced outwardly of perforated tube 346*b* by second annular subspace 358*b* therebetween.

The system provides a method for servicing a combination exhaust muffler and aftertreatment element and water trap assembly comprising providing a joint as a service joint, as noted, at a location axially between the axial ends 356*b* and 354*b* of the aftertreatment element 312*b*, and separating the housing sections 222*b* and 224*b* from each other at the service joint 226*b*, such that upon separation of the noted housing sections, one of the axial ends 356*b*, 354*b* of the aftertreatment element 312*b* is axially spaced beyond one of the housing sections 224*b*, 222*b*, and then servicing the aftertreatment element 312*b*. The system also provides a method for saving space in a combination exhaust muffler and aftertreatment element and water trap assembly comprising providing an outlet housing section 222*b* wherein the aftertreatment element 312*b* extends axially into such outlet housing section 222*b*, with the outlet axial end 356*b* of the aftertreatment element 312*b* being within outlet housing section 222*b*, and providing the outlet housing section 222*b* with a sidewall 318*b* extending axially between first and second end walls 244*b* and 342*b* and of larger diameter than aftertreatment element 312*b* and providing an outlet plenum 350*b* of reduced axial extension along the noted first axial direction 240*b* from the outlet axial end 356*b* of the aftertreatment element 312*b*. The method further involves providing the joint 226*b* at a location between the axial ends 356*b* and 354*b* of the aftertreatment element 312*b*. The method further involves spacing the first end wall 244*b* of the outlet housing section 222*b* axially from the outlet axial end 356*b* of the aftertreatment element 312*b* along the noted first axial direction 240*b*, spacing the second end wall 342*b* of the outlet housing section 222*b* axially from the outlet axial end 356*b* of the aftertreatment element 312*b* along the noted second axial direction 252*b*, providing the sidewall 218*b* of the outlet housing section 222*b* with a first span 258*b* extending from the first end wall 244*b* along the noted second axial direction 252*b* to a midpoint 260*b* radially aligned with the outlet axial end 356*b* of the aftertreatment element 312*b*, providing the sidewall 318*b* of the outlet housing section 222*b* with a second span 262*b* extending from the midpoint 260*b* axially along the noted second axial direction 252*b* to the noted second end wall 342*b*, providing the first span 258*b* and the first end wall 244*b* defining an open volume first plenum section at the outlet axial end 256*b* of the aftertreatment element 312*b* and extending axially along the noted first axial direction 240*b* therefrom, providing the second span 262*b* and the second end wall 342*b* defining an annular volume second plenum section at the outlet axial end 356*b* of the aftertreatment element 312*b* and extending axially along the noted second axial direction 252*b* therefrom and in circumscribing relation to the aftertreatment element 312*b*. The method further involves optionally providing the second span 262*b* of greater axial length than the first span 258*b* to reduce and further save space at the outlet axial end 356*b* of the aftertreatment element 312*b* along the noted first axial direction 240*b* therefrom and further reduce the amount of axial extension of the housing 314*b* in the noted first axial direction 240*b* beyond the outlet axial end 356*b* of the aftertreatment element 312*b*.

It is recognized that various equivalents, alternatives and modifications are possible within the scope of the appended claims.

What is claimed is:

1. A combination exhaust muffler and aftertreatment element and water trap assembly, said aftertreatment element being selected from the group consisting of at least one of a catalyst element and a particulate soot filter, said assembly comprising a housing extending axially along a vertical axis and having a housing sidewall, said housing having a lower inlet for receiving exhaust from an internal combustion engine, and an upper outlet for discharging said exhaust and spaced above said lower inlet, said aftertreatment element being housed in said housing and spaced radially inwardly of said housing sidewall by a radial gap defining an annular space therebetween, a dome care in said housing above said aftertreatment element and below said upper outlet and blocking entry of water axially downwardly therepast into said aftertreatment element from said upper outlet and instead diverting and shedding said water radially outwardly into said annular space, and one or more drain holes draining water from said annular space, wherein said housing has a lower flange spanning and closing said annular space to form a collection space for said water, and comprising a perforated tube extending axially in said housing between said lower flange and said dome care and through which exhaust flows radially outwardly, said perforated tube being in said annular space and radially between said aftertreatment element and said housing sidewall, wherein said dome care is axially spaced above said aftertreatment element by a first axial gap, and is axially spaced below said upper outlet by a second axial gap, said aftertreatment element has an inlet face facing axially downwardly, and has an outlet face facing axially upwardly toward said dome care and axially spaced therebelow by said first axial gap, wherein said perforated tube divides said annular space into a first annular subspace and a second annular subspace, said perforated tube being radially spaced outwardly of said aftertreatment element by said first annular subspace therebetween, said housing sidewall being radially spaced outwardly of said perforated tube by said second annular subspace therebetween.

2. The combination exhaust muffler and aftertreatment element and water trap assembly according to claim 1 wherein said perforated tube has an axial extension portion horizontally aligned with said aftertreatment element below said outlet face of said aftertreatment element, and wherein exhaust flows axially upwardly through said aftertreatment element from said inlet face to said outlet face then axially upwardly into said first axial gap then radially outwardly in said first axial gap then axially downwardly in said first annular sub space then radially outwardly through said axial extension portion of said perforated tube then axially upwardly in said second annular subspace, providing double flow reversal from said outlet face of said aftertreatment element to said first annular subspace to said second annular subspace.

3. The combination exhaust muffler and aftertreatment element and water trap assembly according to claim 1 wherein said perforated tube has a first axial extension portion horizontally aligned with said first axial gap above said outlet face of said aftertreatment element, and has a second axial extension portion below said first axial extension portion and horizontally aligned with said aftertreatment element below said outlet face of said aftertreatment element, and wherein exhaust flows axially upwardly through said aftertreatment element from said inlet face to said outlet face then axially upwardly into said first axial gap then radially outwardly in said first axial gap then along first and second branches, said first branch extending radially outwardly through said first axial extension portion of said perforated tube then axially upwardly in said second annular subspace, said second branch extending axially downwardly in said first annular sub space then radially outwardly through said second axial extension portion of said perforated tube then axially upwardly in said second annular subspace and rejoining said first branch.

4. The combination exhaust muffler and aftertreatment element and water trap assembly according to claim 1 comprising a dam in said first annular subspace between said aftertreatment element and said perforated tube, said dam circumscribing said aftertreatment element and extending axially upwardly from said lower flange to an upper axial end below said outlet face of said aftertreatment element, said dam blocking water flow to said aftertreatment element, said one or more drain holes being radially outward of said dam.

5. The combination exhaust muffler and aftertreatment element and water trap assembly according to claim 4 comprising an extension wall circumscribing and extending axially along said aftertreatment element, said extension wall being radially between said aftertreatment element and said dam.

6. The combination exhaust muffler and aftertreatment element and water trap assembly according to claim 5 wherein said extension wall extends axially upwardly beyond said dam toward said outlet face.

7. A combination exhaust muffler and aftertreatment element and water trap assembly, said aftertreatment element being selected from the group consisting of at least one of a catalyst element and a particulate soot filter, said assembly comprising a housing extending axially along a vertical axis and having a housing sidewall, said housing having a lower inlet for receiving exhaust from an internal combustion engine, and an upper outlet for discharging said exhaust and spaced above said lower inlet, said aftertreatment element being housed in said housing and spaced radially inwardly of said housing sidewall by a radial gap defining an annular space therebetween, a dome care in said housing above said aftertreatment element and below said upper outlet and blocking entry of water axially downwardly therepast into said aftertreatment element from said upper outlet and instead diverting and shedding said water radially outwardly into said annular space, and one or more drain holes draining water from said annular space, wherein said lower inlet and said upper outlet of said housing communicate respectively with axially distally opposite ends of said aftertreatment element, namely a lower inlet face and an upper outlet face, said housing comprising first and second housing sections meeting at a joint axially between said axial ends of said aftertreatment element, wherein said first housing section is an outlet housing section; said aftertreatment element extends axially into said outlet housing section along a first axial direction, and said aftertreatment element has an outlet axial end within said outlet housing section; said outlet housing section has a sidewall extending axially between first and second end walls and of larger diameter than said aftertreatment element and providing an outlet plenum, wherein: said first end wall of said outlet housing section is axially spaced from said outlet axial end of said aftertreatment element along said first axial direction; said second end wall of said outlet housing section is axially spaced from said outlet axial end of said aftertreatment element along a second axial direction, said second axial direction being opposite to said first axial direction; said sidewall of said outlet housing section has a first span extending from said first end wall axially along said second axial direction to a midpoint radially aligned with said outlet axial end of said aftertreatment element, and has a second span extending from said midpoint axially along said second axial direction to said second end wall, said first span and said first end wall defining a first plenum section at said outlet axial end of said aftertreatment element and extending axially along said first axial direction therefrom, said second span and said second end wall defining an annular second plenum section at said outlet axial end of said aftertreatment element and extending axially along said second axial direction therefrom and in circumscribing relation to said aftertreatment element; said second end wall comprises a lower flange spanning and closing said annular space to form a collection space for said water.

8. The combination exhaust muffler and aftertreatment element and water trap assembly according to claim 7 wherein said one or more drain holes are formed through at least one of said lower flange and said housing sidewall.

9. The combination exhaust muffler and aftertreatment element and water trap assembly according to claim 7 wherein the axial length of said second span is greater than the axial length of said first span to reduce and save space at said outlet axial end of said aftertreatment element along said first axial direction therefrom and reduce the amount of axial extension of said housing in said first axial direction beyond said outlet axial end of said aftertreatment element.

10. The combination exhaust muffler and aftertreatment element and water trap assembly according to claim 9 wherein said sidewall is of larger diameter than said second housing section.

11. The combination exhaust muffler and aftertreatment element and water trap assembly according to claim 7 comprising a perforated tube extending axially in said housing between said lower flange and said dome cap and through which exhaust flows radially outwardly, said perforated tube being in said annular space and radially between said aftertreatment element and said housing sidewall.

12. The combination exhaust muffler and aftertreatment element and water trap assembly according to claim 11 wherein said dome cap is axially spaced above said aftertreatment element by a first axial gap, and is axially spaced below said upper outlet by a second axial gap, said perforated tube divides said annular space into a first annular subspace and a second annular subspace, said perforated tube being radially spaced outwardly of said aftertreatment element by said first annular subspace therebetween, said housing sidewall being radially spaced outwardly of said perforated tube by said second annular subspace therebetween.

* * * * *